United States Patent [19]

Nanba

[11] Patent Number: 4,984,538

[45] Date of Patent: Jan. 15, 1991

[54] COOLING SYSTEM FOR V-TYPE ENGINE

[75] Inventor: Seiji Nanba, Aki, Japan

[73] Assignee: Mazda Motor Corporation, Hiroshima, Japan

[21] Appl. No.: 439,937

[22] Filed: Nov. 21, 1989

[30] Foreign Application Priority Data

Nov. 21, 1988 [JP] Japan ..... 63-294381

[51] Int. Cl.[5] ..... F01P 7/14

[52] U.S. Cl. ..... 123/41.1; 123/41.29

[58] Field of Search ..... 123/41.01, 41.1, 41.28, 123/41.29, 41.48, 41.72, 41.74, 55 VF, 55 VS, 55 VE

[56] References Cited

U.S. PATENT DOCUMENTS

| | | | |
|---|---|---|---|
| 1,848,987 | 3/1932 | Anibal | 123/41.29 |
| 2,713,332 | 7/1955 | Beasdsley | 123/41.74 |
| 2,936,745 | 5/1960 | Frank | 123/41.29 |

FOREIGN PATENT DOCUMENTS

| | | | |
|---|---|---|---|
| 2613426 | 10/1988 | France | 123/55 VS |
| 61-128329 | 8/1986 | Japan . | |
| 61-128335 | 8/1986 | Japan . | |

*Primary Examiner*—Noah P. Kamen

*Attorney, Agent, or Firm*—Wenderoth, Lind & Ponack

[57] ABSTRACT

A cooling system for a V-type engine includes an a cross-flow type radiator arranged substantially parallel with an engine body and having a pair of tanks on opposite sides thereof. A water pump is mounted on one end of the engine body, a thermostat is disposed at the other end of the engine body, a coolant inlet port is formed the end of the engine body at which the water pump is provided for supplying coolant from the water pump into the engine body, and a coolant outlet port is formed the same end of the engine body at which the coolant inlet port is formed for discharging the coolant out of the engine body. A coolant return port is provided at one tank of the radiator adjacent to the water pump for returning the coolant from the engine body. A coolant supply port is provided at the other tank of the radiator isolated from the water pump for supplying the coolant to the engine body. A suction line is positioned in a V-shaped shape of the engine between the thermostat and the water pump.

22 Claims, 3 Drawing Sheets

FIG. 1 "PRIOR ART"
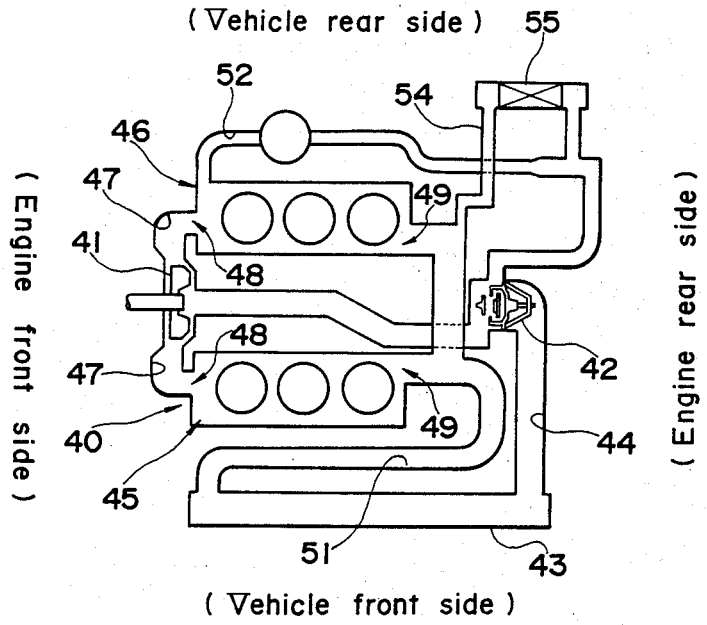
FIG. 3
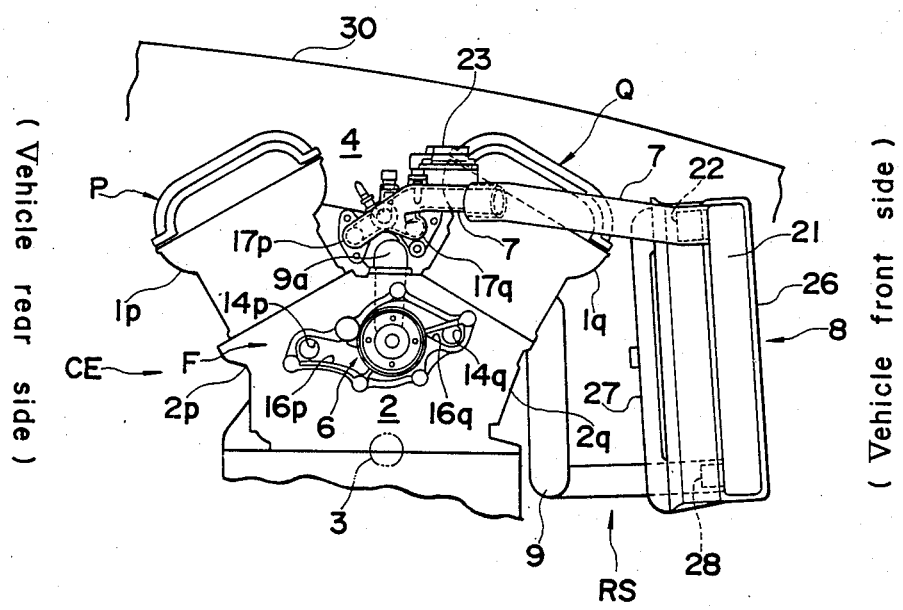

COOLING SYSTEM FOR V-TYPE ENGINE

BACKGROUND OF THE INVENTION

1. Field of the Invention

This invention relates to a cooling system for a V-type engine transversely mounted on a motor vehicle.

2. Description of the Prior Art

In a motor vehicle with a transversely mounted V-type engine, a radiator is disposed at the front of the engine as viewed in the longitudinal direction of the vehicle, with the radiation surface thereof arranged nearly perpendicularly in relation to the longitudinal direction of the vehicle, such that outside air will hit the radiation surface nearly perpendicularly during travel. That is, the radiator is installed on the side of the engine with the radiation surface thereof being nearly in parallel with the axis of an engine crankshaft. Therefore, there is a problem that various members of the cooling system, such as a water pump and a thermostat, are arranged in a space provided on the side of the engine, and accordingly it is impracticable to manufacture compact engines. Furthermore there also is a problem that because an exhaust system and other systems are disposed on the side of the engine, the cooling system interfered with such systems, resulting in a difficult layout of the cooling system on the side of the engine. To cope with these disadvantages, there has been proposed a cooling system for the V-type engine wherein the water pump and the thermostat are mounted at the end section of the engine (hereinafter referred to simply as "the engine end section") as viewed in the axial direction of the crankshaft.

In the conventional cooling system for the transversely mounted V-type engine, as shown for example in FIG. 1, a water pump 41 is mounted at the front end of an engine 40; a thermostat 42 is disposed at the rear end; and a suction line 44 communicating with a radiator 43 and the suction port of the water pump 41 is arranged through the thermostat 42 and a V-like space between the banks 45 and 46 of cylinders of the engine. The coolant is supplied to the engine 40 from the water pump 41 through coolant supply lines 47 via coolant inlet ports 48. This coolant is returned to the radiator 43 through a coolant return line 51 via coolant outlet ports 49 provided at the rear end of the engine 40. Furthermore, there is provided a bypass line 52 for returning the coolant to the suction line 44 by bypassing it through the radiator 43 when the coolant temperature is low. A part of the coolant is supplied also to a driver's seat heater 55 through a coolant line 54 for the heater.

Furthermore, in a conventional cooling system as shown in FIG. 1, since the water pump 41 and the thermostat 42 are not mounted on the side of the engine 40, a much larger space is provided at the side of the engine 40, thereby preventing interference between these devices and the exhaust system. However, because of the presence of the coolant return line 51 and the bypass line 52 on the side of the engine 40, it is still impossible to make the engine substantially compact.

Furthermore, with a recent increase in the number of drivers who are fond of low-hood vehicles, the production of low-hood vehicles has been demanded. In conventional cooling systems, the radiator to be mounted in a position where the height of the hood should be held to a minimum extends largely in a vertical direction in order to improve the cooling efficiency, with the result that the hood can not be substantially lowered.

Besides the above-described conventional art, a technique is known in the prior art (Laid-Open Japanese Utility Model No. 61-128335) for providing the coolant inlet port in one end of the engine body for leading the coolant into the engine, disposing the coolant outlet port in the other end of the engine body, and positioning a communication line connecting the outlet port to the radiator in a space between the radiator and the engine body. According to this technique, however, the space required for mounting the cooling system increases in the direction the width of the engine.

SUMMARY OF THE INVENTION

The present invention has been accomplished to overcome the drawbacks mentioned above and has as its object the provision of a cooling system for a transversely mounted V-type engine which can effectively enable the production of compact engines and accordingly vehicles with low engine hood.

In order to attain the above-mentioned object, the present invention provides a cooling system for a V-type engine including an engine body in which a crankshaft is transversely disposed to extend in a transverse direction of a vehicle body and a pair of banks arranged in a "V" configuration and spaced from each other in a longitudinal direction of the vehicle body define a V-shaped space therebetween which transversely extends along the axis of the crankshaft and continues upwardly of the engine body. The cooling system for a includes a cross-flow type radiator arranged nearly parallel the engine body along the axis of the crankshaft and having a pair of tanks on opposite sides thereof spaced along the axis of the crankshaft; a water pump mounted on one end of the engine body in the direction of the axis of the crankshaft; a coolant inlet port formed at one end of the engine body where the water pump is provided, for supplying coolant from the water pump into the engine body; a coolant outlet port formed the same end of the engine body where the coolant inlet port is formed for discharging the coolant out of the engine body; a coolant return port provided at one tank of the radiator adjacent to the water pump for passing the coolant from the coolant outlet port of the engine body therethrough; a coolant supply port provided at the other tank of the radiator at a position isolatedly from the water pump for discharging coolant cooled by the radiator; a suction line positioned in the V-shaped space and extending from an end of the engine body opposite to the one end thereof to the water pump along the axis of the crankshaft for connecting the coolant supply port with the water pump to supply the coolant from the radiator to the water pump; and a coolant return line arranged at the end of the engine body where the water pump is provided, and extending to the axis of the crankshaft at substantially a right angle, for connecting the coolant outlet port with the coolant pass port to return the coolant from the engine body to the radiator.

According to the present invention, the radiator is of the cross-flow type that the tank on the coolant inflow side and the tank on the coolant outflow side are mounted at the right and left end sections of the radiator body. Therefore, it is possible to control the height of the radiator without decreasing the radiating surface area, as compared with a common radiator with two tanks mounted at upper and lower end sections of the radiator body, thereby enabling the arrangement of the hood in a lower position and the production of low-hood vehicles.

Inasmuch as the coolant supply port of the radiator is provided in the radiator tank that is isolated from the water pump, it is possible to dispose the water pump suction line connected between the coolant supply port of the radiator and the water pump via the side of the engine at which the water pump is not mounted, that is, via the end portion of the engine body close to the coolant supply port of the radiator and the V-shaped space between the banks. Therefore, there is no necessity of arranging the suction line on a side of the engine body. Also, since both the coolant inlet and outlet ports of the engine body are arranged in the engine body at the same end at which the water pump is mounted, the coolant return line connecting the coolant outlet port of the engine body to the coolant return port of the radiator can be connected directly to the coolant return port of the radiator and can be extended from the coolant outlet port of the engine body nearly perpendicularly with the axis of the crankshaft, without passing along a side of the engine body. It is therefore possible to design and manufacture compact engines by effectively utilizing the space on the side (on the radiator side) of the engine body.

The radiator is mounted obliquely and inclined rearwardly in the longitudinal direction of the vehicle body.

The water pump discharges the coolant and the coolant flows, in order, from a jacket formed in a cylinder block of the engine body through jackets formed in cylinder heads of the engine body to cool the engine body, the radiator cools the coolant introduced through the coolant return line, and then supplies the cooled coolant to the water pump through the suction line. The water pump flows the coolant from one end side of the engine body into the jacket of the cylinder block, such from one end side to the other end side of the engine body, from the jacket of the cylinder block into the jackets of the cylinder heads at such other end side of the engine body, in an opposite direction from such other end side the one end side of the engine body, and finally from the jackets of the cylinder heads at such one end side of the engine body. The water pump is disposed at an upper position relative to the crankshaft and in a middle position between the pair of banks cylinder.

The coolant outlet port is formed at an inner surface of the bank which faces the V-shaped space.

The coolant return port is disposed on the upper end side of one tank of the radiator.

The coolant supply port is disposed on the lower end side of the other tank of the radiator.

The suction line extends substantially horizontally rearwardly in the longitudinal direction of the vehicle body from a position connected with the coolant supply port to a position nearly corresponding to the front side of one of the banks located forwardly in the longitudinal direction of the vehicle body, is bent at this position substantially at a right angle in the transverse direction of the vehicle body to extend substantially horizontally to a position in the vicinity of such other end of the engine body, is extended upwardly from this position of extension to the level of the V-shaped space, is bent horizontally from this position of extension rearwardly in the longitudinal direction of the vehicle body, is bent from this bent position in the transverse direction of the vehicle body into the V-shaped space, and further is extended to such one end side of the engine body along the axis of the crankshaft in the V-shaped space and is connected with the water pump.

The coolant return line connected downstream of the coolant outlet port is provided at the topmost position thereof with a coolant filler port for filling coolant and also for bleeding air.

The present invention provides a cooling system for a V-type engine including an engine body in which a crankshaft is transversely disposed to extend in a transverse direction of a vehicle body and a pair of banks arranged in a "V" configuration spaced from each other in a longitudinal direction of the vehicle body define a V-shaped space therebetween which transversely extends along an axis of the crankshaft and continues upwardly of the engine body. The cooling system includes a radiator disposed on a side of the engine body; a water pump mounted on one end of the engine body in the direction of the axis of the crankshaft; a thermostat disposed at the other end of the engine body opposite to one end thereof at which is mounted the water pump side; a coolant inlet port formed at such one end of the engine body for supplying coolant from the water pump into the engine body; a coolant outlet port formed at such one end of the engine body for discharging the coolant out of the engine body; a suction line positioned in the V-shaped space from the thermostat at such other end of the engine body and extending such one end of the engine body along the axis of the crankshaft, for connecting the radiator with the water pump to supply cooled coolant to the water pump; a coolant return line connecting the coolant outlet port with the radiator for returning the coolant from the engine body to the radiator; and a bypass line positioned in the V-shaped space from such one end to such other end of the engine body for connecting the coolant return line downstream of the coolant outlet port to the coolant thermostat allow the to bypass radiator.

According to the present invention, the bypass line is arranged adjacent to the suction line in the V-shaped space between the banks, and therefore it is unnecessary to install the bypass line on the side opposite the radiator of the engine body, as is the case in conventional cooling systems. Therefore the space on the side of the engine opposite the radiator can effectively be utilized, further enabling the mounting of a compact engine. Furthermore, in the engine body, the coolant that has entered the cylinder block at the end at which the water pump is mounted flows into the cylinder head at the end section at which the thermostat is mounted and then flows out at the end section at which the water pump is mounted, after circulating in the cylinder head. Thereby there is achieved better cooling of cylinders in the cylinder block which are located near the water pump and also better cooling of cylinders in the cylinder head which are located apart from the water pump, thus uniformly cooling all the cylinders of the engine.

The radiator is mounted obliquely inclined rearwardly in the longitudinal direction of the vehicle body.

The water pump discharges the coolant and causes the coolant to flow, in order, from a jacket formed in a cylinder block of the engine body through jackets formed in cylinder heads of the engine body to cool the engine body. The radiator then cools the coolant introduced through the coolant return line and previously heated by cooling the engine body and returns the coolant to the water pump through the suction line. The water pump causes the coolant to flow from one end side of the engine body into the jacket of the cylinder block, pass from such one end side to the other end side of the engine body, flow from the jacket of the cylinder block into the jackets of the cylinder heads at such other end side of the engine body, pass in the opposite direction from such other end side to such one end side of the engine body, and finally pass from the jackets of the cylinder heads at such one end side of the engine body. The water pump is disposed at an upper position relative to the crankshaft and at a middle position between the pair of banks.

The thermostat inserted in the suction line closes a path thereof from the radiator and enables the coolant in the coolant return line to pass directly to the suction line through the bypass line when the coolant temperature is low.

The coolant outlet port is formed at an inner surface of the bank which faces the V-shaped space.

The suction line extends substantially horizontally rearwardly in the longitudinal direction of the vehicle body from a position connected with the radiator to a position nearly corresponding to the front side of one of the banks located forwardly in the longitudinal direction of the vehicle body, is bent at this position of extension nearly at a right angle in the transverse direction of the vehicle body to extended substantially horizontally to a position in the vicinity of the other end of the engine body, is extended upwardly from this position of extension to the level of the V-shaped space, is horizontally bent from this position of extension rearwardly in the longitudinal direction of the vehicle body to connected with the thermostat, is extended from the thermostat in the transverse direction of the vehicle body into the V-shaped space, and further is extended to the one end side of the engine body along the axis of the crankshaft in the V-shaped space to be connected with the water pump.

The coolant return line connected downstream of the coolant outlet port is provided at a topmost position thereof with a coolant filler port for filling the coolant and also for bleeding air.

The bypass line is provided for communication between the thermostat and the coolant return line at a position upstream of the coolant filler port. The bypass line is installed adjacent to the suction line in the V-shaped space at a position above the suction line.

A heater is disposed at a position opposite to the radiator relative to the engine body, and a supply line for feeding the coolant to the heater and a return line for returning the coolant from the heater connect the heater with the thermostat on the side opposite to the radiator.

Furthermore, the present invention provides the cooling system for a V-type engine including an engine body in which a crankshaft is transversely disposed to extend in a transverse direction of a vehicle body and a pair of banks arranged in a "V" configuration spaced each other in a longitudinal direction of the vehicle body define a V-shaped space therebetween which transversely extends along an axis of the crankshaft and continues upward of the engine body. The cooling system includes a cross-flow type radiator arranged substantially parallel with the engine body along the axis of the crankshaft and having at opposite sides a pair of tanks spaced along the axis of the crankshaft. A water pump is mounted on one end of the engine body in the direction of the axis of the crankshaft an a thermostat is disposed at the other end of the engine body opposite to the water pump. A coolant inlet port is formed at the one end of the engine body where the water pump is provided for supplying coolant from the water pump into the engine body. A coolant outlet port is formed at the one end of the engine body where the coolant inlet port is formed for discharging the coolant out of the engine body. A coolant return port is provided at one tank of the radiator adjacent to the water pump for returning the coolant from the engine body to the radiator. A coolant supply port is provided at the other tank of the radiator at a position isolated from the water pump for supplying cooled coolant from the radiator to the water pump. A suction line is positioned in the V-shaped space between the thermostat and the water pump and extends along the axis of the crankshaft for connecting the coolant supply port with the water pump to supply the coolant from the radiator to the water pump. A coolant return line arranged at the side of the one end of the engine body where the water pump is provided extends at substantially a right angle to the axis of the crankshaft for connecting the coolant outlet port with the coolant return port to return the coolant from the engine body to the radiator. A bypass line extends in the V-shaped space from the one end to the other end of the engine body for connecting the coolant return line at a position downstream of the coolant outlet port with the thermostat, to enable the coolant bypass the radiator.

For a better understanding of the present invention as well as other objects and further features, reference is had to the following drawings and description.

BRIEF DESCRIPTION OF THE DRAWINGS

FIG. 1 is a schematic block diagram of a conventional cooling system of a transversely mounted V-6 engine;

FIGS. 2 and 3 are an explanatory plan view and an explanatory front view of a transversely mounted V-6 engine and its cooling system according to an embodiment of this invention.

DESCRIPTION OF THE PREFERRED EMBODIMENT

Hereinafter an exemplary embodiment of a cooling system according to the present invention will be described with reference to the accompanying drawings.

Figure 2:
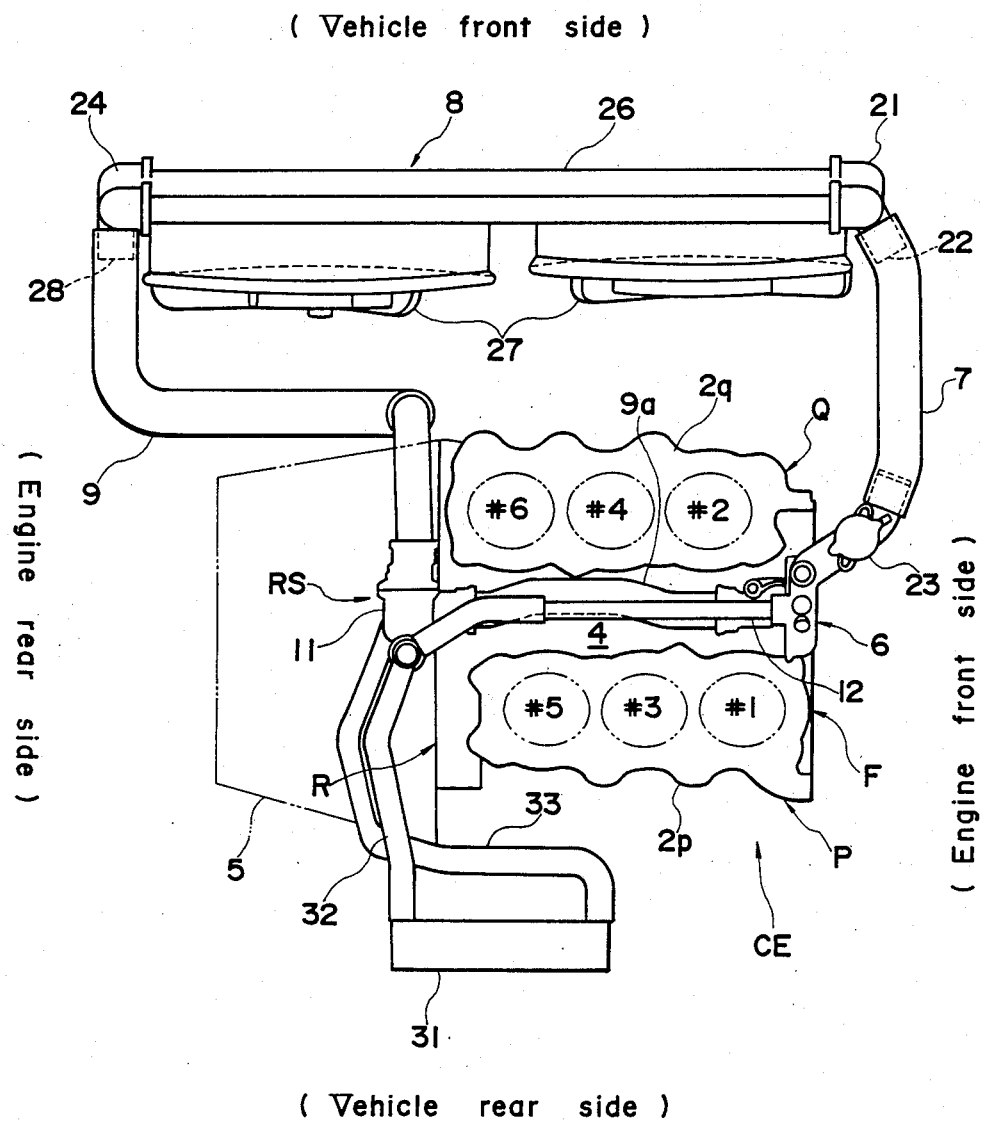

As shown in FIGS. 2 and 3, the V-6 engine CE which is transversely mounted on the vehicle has a first bank P composed of a first cylinder head 1*p* and a first cylinder block section 2*p* of a cylinder block 2, and a second bank Q composed of a second cylinder head 1*q* and a second cylinder block section 2*q* of the cylinder block 2. Both the banks P and Q are formed so as to be lengthwise in parallel with the axis of a crankshaft 3. Between both the banks P and Q is formed a V-shaped space 4. In the first bank the first, third and fifth cylinders #1, #3 and #5 are arranged in order of mention from the front end F of the engine; and in the second bank Q, the second, fourth and sixth cylinders #2, #4 and #6 are arranged in order of mention from the front end F of the engine. The engine CE is transversely arranged with the second bank Q located on the front side of vehicle as viewed in the longitudinal direction and the crankshaft 3 placed in the direction of vehicle width. That is, the front end F of the engine CE is on the right-hand side of the vehicle (on the right side in FIG. 2), and the rear end R is on the left-hand side of the vehicle (the left side in FIG. 2). At the rear end R of the engine CE is mounted a transmission 5.

For the cooling of the engine CE is provided a cooling system RS. This cooling system RS is basically designed and constituted to cool the engine CE by passing the coolant being discharged from a water pump 6, through jackets in the first and second cylinder block sections 2*p* and 2*q* and jackets in the first and second cylinder heads 1*p* and 1*q* in such order, to cool the coolant thereby heated by leading it into a cross-flow type radiator 8 through a coolant return line 7, and further to return this coolant thus cooled by the radiator 8 into the water pump 6 through a suction line 9. When the coolant temperature is too low, a thermostat 11 is essential to prevent overcooling of the engine CE. The thermostat 11 is inserted in the suction line 9 to return the coolant from the coolant return line into the suction line 9 through a bypass line 12 for bypassing the radiator 8.

Hereinafter the members of the cooling system RS further will be explained.

Figure 4:
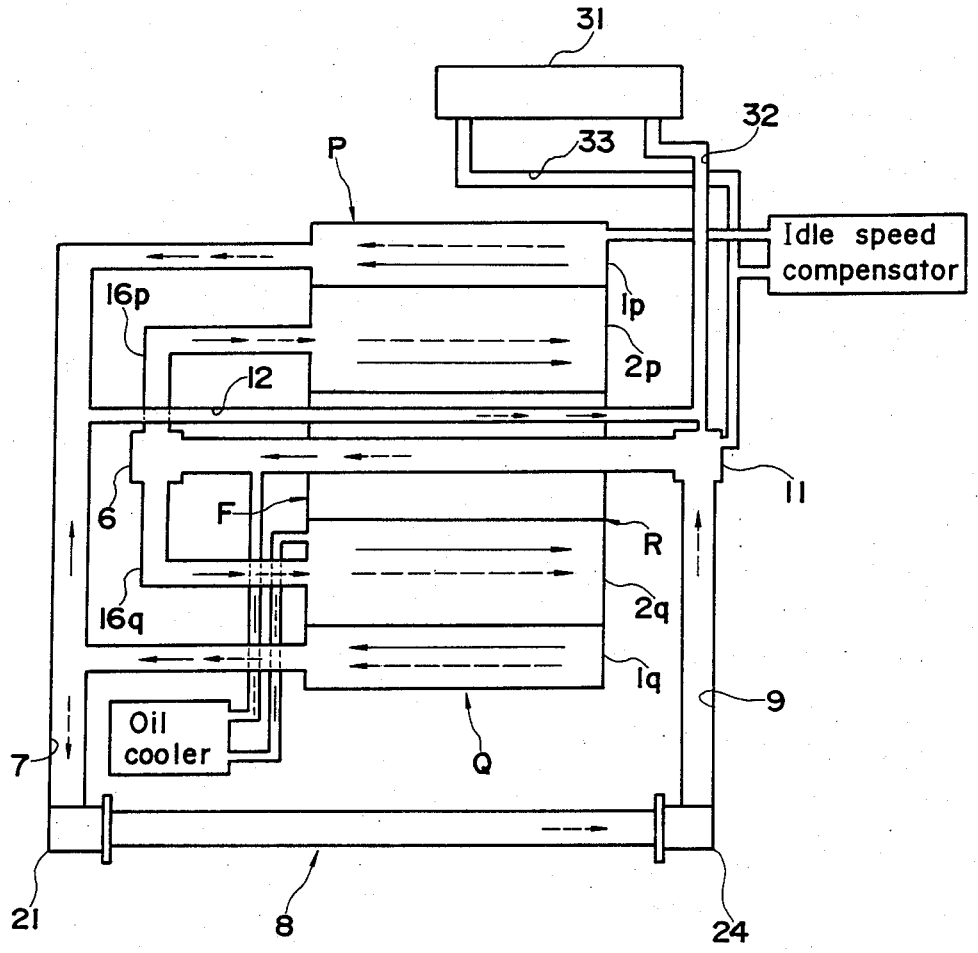
FIG. 4 is a view showing the direction of flow of the coolant within the cooling system shown in FIG. 2.

The water pump 6 driven by the crankshaft 3 through a belt (not illustrated) is mounted in the middle position between the banks P and Q as viewed in the direction of the width of the engine CE, a little above the crankshaft 3, at the front end F of the cylinder block 2. In the front end F of the first and second cylinder block sections 2*p* and 2*q* are provided coolant inlet ports 14*p* and 14*q* of the jackets thereof. These coolant inlet ports 14*p* and 14*q* are connected with the discharge port of the water pump 6 through first and second coolant supply lines 16*p* and 16*q*. In the meantime, in the inner sides of the first and second cylinder heads 1*p* and 1*q* are formed, near the front end F, coolant outlet ports 17*p* and 17*q* of these jackets. These coolant outlet ports 17*p* and 17*q* are connected to the coolant return line 7. Here, the main stream of the coolant discharged from the water pump 6 is, as shown in FIG. 4, circulated from the front F side of the engine CE into the jackets of the first and second cylinder blocks 2*p* and 2*q*, flowing in the interiors thereof from the front F side toward the rear R side, passing into the first and second cylinder heads 1*p* and 1*q* in the vicinity of the rear end section R, passing through the interiors thereof from the rear R side toward the front F side, and finally flowing out at the front F side of the engine CE. As described above, the direction of flow of the coolant differs between the cylinder block sections 2*p* and 2*q* and the cylinder heads 1*p* and 1*q*; therefore the cooling of all the cylinders #1 to #6 of the engine CE is effected uniformly on the whole, thus enabling uniform output power of cylinders #1 to #6.

The above-described coolant return line 7 extends toward the front of the vehicle as viewed longitudinally (in the direction of the width of the engine CE), gradually curving downward after rising slightly from the connection of the coolant outlet ports 17*p* and 17*q*. The downstream end of this coolant return line 7 is connected to a coolant return port 22 provided in the vicinity of the top end section of a first tank 21 of the radiator 8. Therefore, the coolant return line 7 is connected to the radiator 8 without passing on the side of the engine CE. At the top level of the coolant return line 7 located slightly downstream of the coolant outlet ports 17*p* and 17*q* is provided a filler port 23 for filling coolant and bleeding air from the cooling system.

At the right end (the right side in FIG. 2) of a body section 26 of the radiator 8 is mounted the first tank 21. Also, at the left end (the left side in FIG. 2) of the radiator body section 26 is mounted a second tank 24. At the rear of the radiator body section 26 as viewed in the longitudinal direction of vehicle, fans 27 are provided to supply outside air into the radiator body section 26. Since the cross-flow type radiator 8 with the tanks 21 and 24 arranged at the right and left ends is adopted, the height of the radiator 8 can be restrained without reducing the cooling surface area of the radiator body section 26 as compared with a common radiator with two tanks mounted at the upper and lower end sections of its body section, thus enabling the mounting of a vehicle hood 30 in a low position. The cooling surface of the radiator 8 is arranged inclined slightly rearwardly from the vertical direction for the purpose of further restraining the hood height, thereby realizing a low-hood vehicle.

In the vicinity of the lower end of the second tank 24 of the radiator 8 is provided a coolant supply port 28. This coolant supply port 28 and a suction port of the water pump 6 are connected through the suction line 9. And at the rear end R of the first and second cylinder block sections 2*p* and 2*q* and in a position nearly corresponding to the water pump 6, the thermostat 11 described later is mounted to the suction line 9. The aforesaid suction line 9 is curved nearly at right angles slightly before a position corresponding to the front side of the second bank Q after extending nearly horizontally backward from the connection with the coolant supply port 28 as viewed in the longitudinal direction of the vehicle, then extends horizontally to the right (to the right in FIG. 2) in the direction of vehicle width, then changes its direction to a vertical upward direction in the vicinity of the rear end R of the engine CE, then extends nearly horizontally after changing its direction backward in the longitudinal direction of the vehicle in the vicinity of the upper end section of the second cylinder block section 2*q*, and finally is connected to the thermostat 11.

This suction line 9 further extends from the thermostat 11 along the axis of the crankshaft 3 in the V-shaped space 4 between the banks P and Q, that is, horizontally in the longitudinal direction of both the banks P and Q, and is connected to the suction port of the water pump 6. Hereinafter the portion of the suction line 9 that is arranged in the V-shaped space 4 is specially termed a suction line 9*a* in the V-shaped space. Therefore, the suction line 9 is not arranged on the side of the engine CE between the coolant supply port 28 and the thermostat 11. And as described above, the coolant return line 7 is also not arranged on the side of the engine CE. Thus, none of the cooling system members are arranged on the side of the engine CE adjacent radiator 8. Accordingly, the space section on the side of the radiator 8 of the engine CE can effectively be utilized, thus realizing a compact engine CE. Furthermore, since the suction line 9*a* is arranged in the V-shaped space 4, which otherwise is a dead space, between the thermostat 11 and the water pump 6, the effective utilization of the space in the engine compartment can be realized.

The bypass line 12, for returning the coolant from the coolant return line 7 to the suction line 9 while bypassing the radiator 8 in order to prevent overcooling of the engine CE when the coolant temperature low, is extends between the coolant return line 7 at a position located slightly upstream of the coolant inlet port 23 and the thermostat 11. This bypass line 12 is disposed adjacent to the upper side of the suction line 9*a* in the V-shaped space 4. Since the bypass line 12 is not arranged on the side of the engine CE as described above, the effective use of the space on the side of the engine CE opposite the radiator 8 can be achieved thereby the engine CE to be compact. A heater coolant supply line 32 for leading the coolant (hot water) into a car heater 31 is provided extending from the thermostat 11 in direction opposite of the radiator 8, and also a heater coolant return line 33 is connected to the thermostat 11 at a side opposite the radiator 8. Because no cooling system is mounted at the front F side of the space on the side of the engine CE opposite of the radiator 8, it is possible to effectively use such space to realize a much more compact engine CE.

The thermostat 11, though not particularly illustrated, uses wax pellets which expand and contract with changes in coolant temperature. When the coolant temperature is high, the wax pellets swell to open the suction line 9 and close the bypass line 12, and the coolant in the coolant return line 7 is returned into the water pump 6 after passing through the radiator 8 for cooling. The flow of the coolant in the cooling system RS at this time is indicated by arrow with broken lines in FIG. 4. However, when the coolant temperature is low, the wax pellets contract to close the suction line 9 and at the same time open the bypass line 12, thus bypassing the radiator 8 (without cooling) to pass the coolant from the coolant return line 7 directly to suction line 9 and then back to water pump 6. The flow of the coolant in the cooling system RS at this time is indicated by with solid lines in FIG. 4.

The present invention, as described above, can restrain the radiator height, thereby realizing a compact cooling system and accordingly a low-hood vehicle.

The present invention has been described in detail with particular reference to a preferred embodiment thereof but it will be understood that variations and modifications can be effected within the spirit and scope of the invention.

What is claimed is:

1. A cooling system for a V-type engine including an engine body in which a crankshaft is transversely disposed to extend in a transverse direction of a vehicle body and a pair of banks arranged in a "V" configuration are spaced from each other in a longitudinal direction of the vehicle body to define a V-shaped space therebetween which transversely extends along an axis of the crankshaft and continues upwardly of the engine body, said cooling system comprising:

a cross-flow type radiator arranged to extend substantially parallel of the engine body along the axis of the crankshaft and having a pair of tanks on opposite sides thereof spaced along the axis of the crankshaft;

a water pump mounted on one end of said engine body in the direction of the axis of the crankshaft;

a coolant inlet port formed at said one end of said engine body for supplying coolant from said water pump into said engine body;

a coolant outlet port formed at said one end of said engine body where said coolant inlet port is formed for discharging the coolant from said engine body;

a coolant return port provided at one said tank of said radiator adjacent to said water pump for receiving therethrough the coolant from said engine body;

a coolant supply port provided at the other said tank of said radiator that is isolated from said water pump for supplying the coolant to said engine body therethrough;

a suction line, positioned in said V-shaped space and extending from the other end of said engine body opposite to said one end thereof to said one end thereof along the axis of said crankshaft, for connecting said coolant supply port with said water pump to supply the coolant from said radiator to said water pump; and a coolant return line, arranged at the side of said one end of said engine body and extending at substantially a right angle to the axis of said crankshaft, for connecting said coolant outlet port with said coolant return port to return the coolant from said engine body to said radiator.

2. A cooling system for a V-type engine as claimed in claim 1, wherein said radiator is mounted obliquely inclined rearwardly in the longitudinal direction of said vehicle body.

3. A cooling system for a V-type engine as claimed in claim 1, wherein said water pump discharges the coolant and causes the coolant flow from a jacket formed in a cylinder block of said engine body through jackets formed in cylinder heads of said engine body to cool said engine body, and said radiator cools the coolant introduced through said coolant return line and heated by cooling said engine body and supplies the coolant to said water pump through said suction line.

4. A cooling system for a V-type engine as claimed in claim 3, wherein said water pump discharges the coolant to flow from one end side of said engine body into said jacket of said cylinder block, to pass from said one end side to the other end side of said engine body, to flow from said jacket of said cylinder block into said jackets of said cylinder heads at said other end side of said engine body, to pass in the opposite direction from said other end side to said one end side of said engine body, and finally to pass from said jackets of said cylinder heads at said one end side of said engine body.

5. A cooling system for a V-type engine as claimed in claim 1, wherein said water pump is disposed at an upper position relative to said crankshaft and at a middle position between said pair of banks.

6. A cooling system for a V-type engine as claimed in claim 1, wherein said coolant return port is disposed on an upper end side of said one tank of said radiator.

7. A cooling system for a V-type engine as claimed in claim 1, wherein said coolant supply port is disposed on a lower end side of said other tank of said radiator.

8. A cooling system for a V-type engine as claimed in claim 1, wherein said suction line extends substantially horizontally rearwardly in the longitudinal direction of said vehicle body from a first position connected with said coolant supply port to a second position substantially corresponding to the front side of one of said banks located forward in the longitudinal direction of said vehicle body, is bent at said second position substantially at a right angle in the transverse direction of said vehicle body to extend substantially horizontally to a third position in the vicinity of said other end of said engine body, is extended upwardly from said third position to a fourth position at the level of said V-shaped space, is horizontally bent from said fourth position rearwardly in the longitudinal direction of said vehicle body to a fifth position, is bent from said fifth position in the transverse direction of said vehicle body into said V-shaped space, and further is extended to one end side of said engine body along the axis of said crankshaft in said V-shaped space and connected with said water pump.

9. A cooling system for a V-type engine as claimed in claim 1, wherein said coolant return line includes, at a location downstream of said coolant outlet port and at a topmost position thereof, a coolant filler port for filling the coolant and also for bleeding air.

10. A cooling system for a V-type engine including an engine body in which a crankshaft is transversely disposed to extend in a transverse direction of a vehicle body and a pair of banks arranged in a "V" configuration are spaced from each other in a longitudinal direction of the vehicle body to define a V-shaped space therebetween which transversely extends along an axis of the crankshaft and continues upwardly of the engine body, said cooling system comprising:

a radiator disposed at a side of said engine body;

a water pump mounted on one end of said engine body in the direction of the axis of the crankshaft;

a thermostat disposed at the other end of said engine body opposite to said one end thereof;

a coolant inlet port formed at said one end of said engine body for supplying coolant from said water pump into said engine body;

a coolant outlet port formed at said one end of said engine body where said coolant inlet port is formed for discharging the coolant from said engine body;

a suction line, positioned in said V-shaped space and extending from said other end of said engine body to said one end thereof along the axis of said crankshaft, for connecting said radiator through said thermostat with said water pump to supply the coolant to said water pump;

a coolant return line connecting said coolant outlet port with said radiator for returning the coolant from said engine body to said radiator; and a bypass line, extending in said V-shaped space from said one end through said other end of said engine body, for connecting said coolant return line at a position downstream of said coolant outlet port to said thermostat and thereby to enable the coolant to bypass said radiator.

11. A cooling system for a V-type engine as claimed in claim 10, wherein said radiator is mounted obliquely inclined rearwardly in the longitudinal direction of said vehicle body.

12. A cooling system for a V-type engine as claimed in claim 10, wherein said water pump discharges the coolant causes the coolant flow from a jacket formed in a cylinder block of said engine body through jackets formed in cylinder heads of said engine body to cool said engine body, and said radiator cools the coolant introduced through said coolant return line and heated by cooling said engine body and supplies the coolant to said water pump through said suction line.

13. A cooling system for a V-type engine as claimed in claim 12, wherein said water pump discharges the coolant to flow from one end side of said engine body into said jacket of said cylinder block, to pass from said one end side to the other end side of said engine body, to flow from said jacket of said cylinder block into said jackets of said cylinder heads at said other end side of said engine body, to pass in the opposite direction from said other end side to said one end side of said engine body, and finally to pass from said jackets of said cylinder heads at said one end side of said engine body.

14. A cooling system for a V-type engine as claimed in claim 16, wherein said water pump is disposed at an upper position relative to said crankshaft and at a middle position between said pair of banks.

15. A cooling system for a V-type engine as claimed in claim 10, wherein said thermostat inserted in said suction line includes means for closing a path thereof to said radiator to enable the coolant in said coolant return line to flow to said suction line through said bypass line when the coolant temperature is low.

16. A cooling system for a V-type engine as claimed in claim 10, wherein said suction line extends substantially horizontally rearwardly in the longitudinal direction of said vehicle body from a first position connected with said radiator to a second position substantially corresponding to the front side of one of said banks located forward in the longitudinal direction of said vehicle body, is bent at said second position substantially at a right angle in the transverse direction of said vehicle body to extend substantially horizontally to a third position in the vicinity of said other end of said engine body, is extended upwardly from said third position to a fourth position at the level of said V-shaped space, is horizontally bent from said fourth position rearwardly in the longitudinal direction of said vehicle body to a fifth position connected with said thermostat, is extended from said thermostat in the transverse direction of said vehicle body into said V-shaped space, and further is extended to one end side of said engine body along the axis of said crankshaft in said V-shaped space and connected with said water pump.

17. A cooling system for a V-type engine as claimed in claim 10, wherein said coolant return line includes, at a location downstream of said coolant outlet port and at a topmost position thereof, a coolant filler port for filling the coolant and also for bleeding air.

18. A cooling system for a V-type engine as claimed in claim 17, wherein said bypass line connects said thermostat with said coolant return line at a position upstream of said coolant filler port.

19. A cooling system for a V-type engine as claimed in claim 10, wherein said bypass line is positioned adjacent to said suction line in said V-shaped space.

20. A cooling system for a V-type engine as claimed in claim 19, wherein said bypass line is arranged above said suction line in said V-shaped space.

21. A cooling system for a V-type engine as claimed in claim 10, further comprising a heater disposed at a position at a side of said engine body opposite to said radiator, and a supply line for feeding the coolant to said heater and a return line for returning the coolant from said heater connecting said heater with said thermostat at a side thereof opposite to said radiator.

22. A cooling system for a V-type engine including an engine body in which a crankshaft is transversely disposed to extend in a transverse direction of a vehicle body and a pair of banks arranged in a "V" configuration are spaced from each other in a longitudinal direction of the vehicle body to define a V-shaped space therebetween which transversely extends along an axis of the crankshaft and continues upwardly of the engine body, said cooling system comprising:

a cross-flow type radiator arranged to extend substantially parallel of the engine body along the axis of the crankshaft and having a pair of tanks on opposite sides thereof spaced along the axis of the crankshaft;

a water pump mounted on one end of said engine body in the direction of the axis of the crankshaft;

a thermostat disposed at the other end of said engine body opposite to said one end thereof;

a coolant inlet port formed at said one end of said engine body for supplying coolant from said water pump into said engine body;

a coolant outlet port formed at said one end of said engine body where said coolant inlet port is formed for discharging the coolant from said engine body;

a coolant return port provided at one said tank of said radiator adjacent to said water pump for receiving therethrough the coolant from said engine body;

a coolant supply port provided at the other said tank of said radiator that is isolated from said water pump for supplying the coolant to said engine body therethrough;

a suction line positioned in said V-shaped space and extending from said other end of said engine body to said one end thereof along the axis of said crankshaft, for connecting said coolant supply port through said thermostat with said water pump to supply the coolant from said radiator to said water pump;

a coolant return line, arranged at the side of said one end of said engine body and extending at substantially a right angle to the axis of said crankshaft, for connecting said coolant outlet port with said coolant return port to return the coolant from said engine body to said radiator; and a bypass line, extending in said V-shaped space from said one end through said other end of said engine body, for connecting said coolant return line at a position downstream of said coolant outlet port to said thermostat and thereby to enable the coolant to bypass said radiator.

* * * * *